US006717075B1

(12) United States Patent
Stavely et al.

(10) Patent No.: US 6,717,075 B1
(45) Date of Patent: Apr. 6, 2004

(54) METHOD AND APPARATUS FOR A MULTI-SIDED INPUT DEVICE

(75) Inventors: Donald J. Stavely, Windsor, CO (US); Amy E. Battles, Windsor, CO (US); Amol S. Pandit, Greeley, CO (US); Robert F. Yockey, Fort Collins, CO (US); Miles Thorland, Fort Collins, CO (US); Daniel J. Byrne, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/339,078

(22) Filed: Jan. 8, 2003

(51) Int. Cl.[7] ..... H01H 9/26
(52) U.S. Cl. ..... 200/5 R; 200/6 A; 200/5 A
(58) Field of Search ..... 200/5 A, 5 R, 200/6 A, 4, 18, 61.47–61.5, 61.51, 61.52, 18.4, 61–45 R, 50.32, 50.36, 50.4, 61.41; 345/156, 158, 161, 169, 173, 168

(56) References Cited

U.S. PATENT DOCUMENTS

| | | | | | |
|---|---|---|---|---|---|
| 6,072,470 | A | * | 6/2000 | Ishigaki | 345/158 |
| 6,201,484 | B1 | * | 3/2001 | Russell | 341/20 |
| 6,288,709 | B1 | * | 9/2001 | Willner et al. | 345/169 |
| 6,429,846 | B2 | * | 8/2002 | Rosenberg et al. | 345/156 |
| 6,486,868 | B1 | * | 11/2002 | Kazarian | 345/156 |
| 6,545,667 | B1 | * | 4/2003 | Lilenfield | 345/169 |
| 6,573,854 | B1 | * | 6/2003 | Hug et al. | 341/176 |

FOREIGN PATENT DOCUMENTS

| | | | |
|---|---|---|---|
| EP | 185143 | * | 8/1985 |

* cited by examiner

*Primary Examiner*—Michael Friedhofer
*Assistant Examiner*—Lisa Klaus

(57) ABSTRACT

An input device that has controls on more than one side is disclosed. The user orients the input device such that the controls to he used are in a predetermined orientation. A sensor detects which controls are in the predetermined orientation and enables those controls.

17 Claims, 3 Drawing Sheets

METHOD AND APPARATUS FOR A MULTI-SIDED INPUT DEVICE

FIELD OF THE INVENTION

The field of this invention relates to input devices and more specifically to an input device that has controls on more than one side.

BACKGROUND OF THE INVENTION

Controlling an electronic device is typically done using some type of input device. There may be more than one input device for some types of electronic devices. For example a computer has both a keyboard and a mouse. Most TV's have a remote control input device as well as controls on the front of the TV. Some input devices can control more than one electronic device. For example a universal remote control can control a TV, a VCR, the satellite dish, and even the surround sound. Unfortunately, controlling so many devices has its drawbacks. To be able to control so many devices there has to be a lot of different controls or keys on the input device. Some controls or keys are common to many of the different electronic devices, for example the on/off control. Some of the controls only apply to one of the electronic devices, for example the rewind key may only apply to the VCR. Because of the large number of controls, it is sometimes difficult to find the key the user wishes to use for the device the user wishes to control. For the user to have only the controls visible for the device they are controlling, they have to have multiple input devices, one for each electronic device they wish to control. Unfortunately that means they have to keep track of multiple input devices and switch input devices when they want to control a different electronic device.

For some electronic devices an expert user may want a different set of controls available than a novice user. For example, an expert user of a print kiosk may want controls available for adjusting the gamma of the image. A novice user would only be confused with the advanced controls. The novice user may only want the basic controls to select the size and number of prints.

There is a need for an input device that can present the appropriate controls to the user.

SUMMARY OF THE INVENTION

An input device that has controls on more than one side is disclosed. The user orients the input device such that the controls to be used are in a predetermined orientation. A sensor detects which controls are in the predetermined orientation and enables those controls.

Other aspects and advantages of the present invention will become apparent from the following detailed description, taken in conjunction with the accompanying drawings, illustrating by way of example the principles of the invention.

DETAILED DESCRIPTION OF THE PREFERRED EMBODIMENT

A typical input device has a face or side where controls are arranged. For example a keyboard has a top side where the keys are placed. The face or side may be a flat plane or the face may be curved. The keyboard typically has a bottom side or face configured to support the keyboard while resting on a surface. In this application a control and a key are used interchangeably to indicate a user control. A user control is a key, switch, or device that allows a user to input control information into a device.

Figure 1:
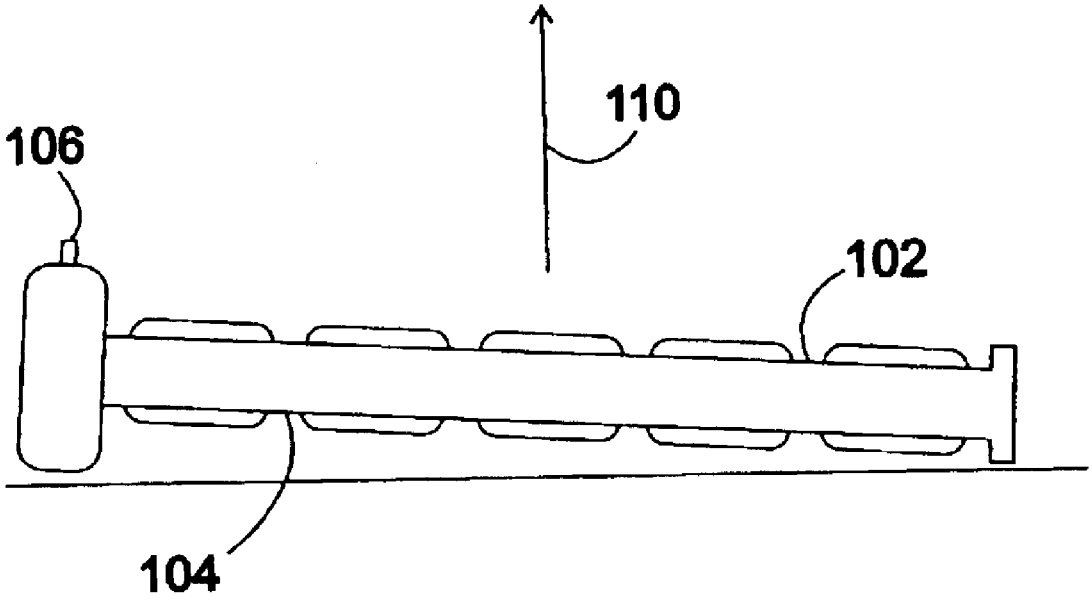
FIG. 1 is a side view of one example embodiment of the current invention.

In one example embodiment of the current invention, the input device would have controls on two sides or faces (see FIG. 1). The two sides would be opposite each other. When one side 102 is in an upward facing orientation the other side 104 would be in a downward facing orientation. The input device would contain a sensor 106 that could detect which side was facing upward. The input device would only enable the controls in the upward facing orientation. When the device was flipped over the other set of controls would become active and the first set of controls would become inactive. The orientation of a side can be described as its facing direction. The facing direction of a side is generally perpendicular to the plane containing the controls and extending outward from the device. Vector 110 is the facing direction for side 102.

In one example embodiment, the sensor 106 would be a pressure switch mounted on one side of the device. When the sensor side was in the downward facing orientation the switch would be depressed indicating that the corresponding set of controls should be inactivated. When the sensor side was in the upward facing orientation, the switch would not be depressed indicating that the corresponding set of controls should be activated. In another example embodiment, the switch would be a gravity-activated switch (not shown), for example a mercury switch or solid-state accellerometer. The gravity-activated switch would be "on" when one face was in the generally downward facing orientation, and "off" when the face was in a generally upward facing orientation. In another embodiment the sensor could be a magnetic sensor (not shown). Magnetic sensors use the magnetic field of the earth to detect the orientation of the device.

In one example embodiment of the current invention the device would be configured to operate resting on a surface. For example the keys or controls would be recessed such that the device would not rest on the controls when the controls where in the downward facing orientation. In another example embodiment the device would be configured to rest on some or all of the controls in the downward facing orientation.

In one example embodiment, the input device would have more controls on one side than on the other side. For example the first side would contain a full set of controls, allowing access to all the features of the device being controlled. On the second face there would be a limited set of controls, allowing access to the basic functions of the device.

Figure 2A:
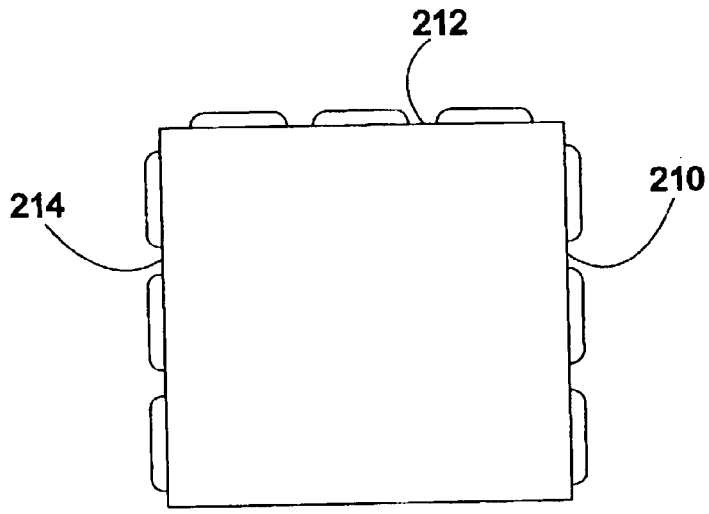
FIG. 2A is an end view of another example embodiment of the current invention.
Figure 2B:
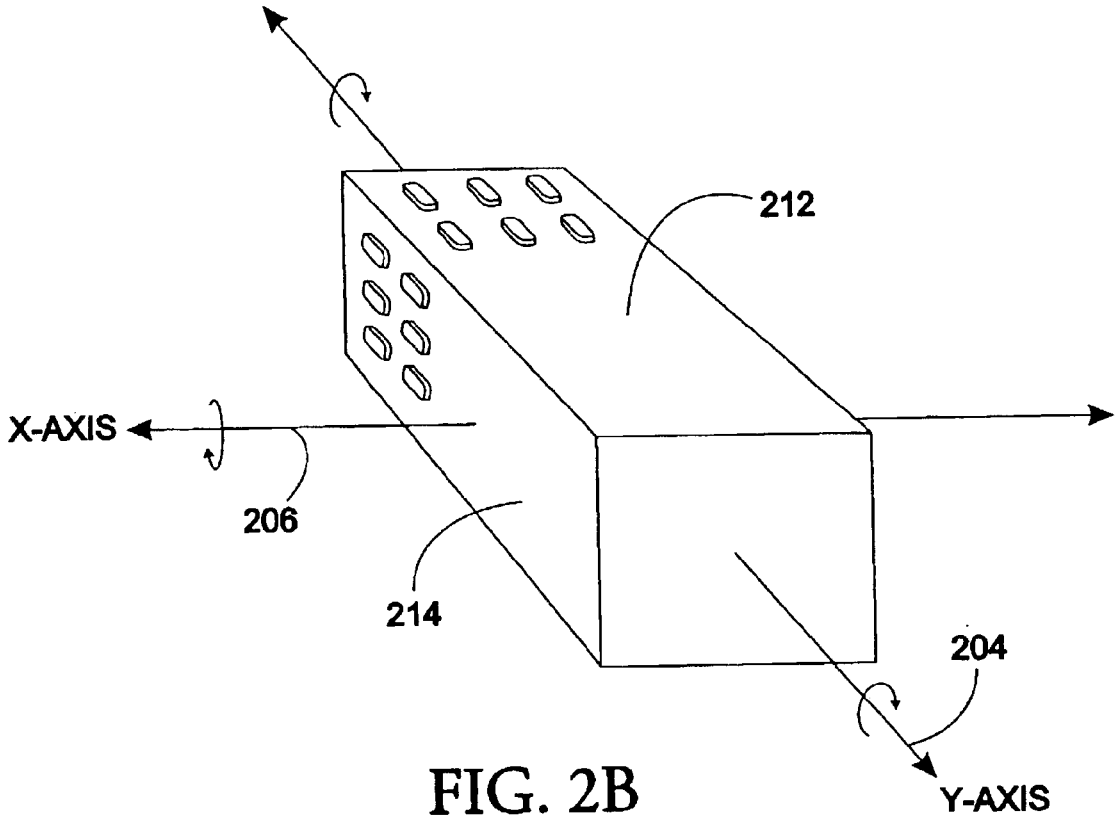
FIG. 2B is a projection view of the example embodiment frorn FIG. 2A.
Figure 3:
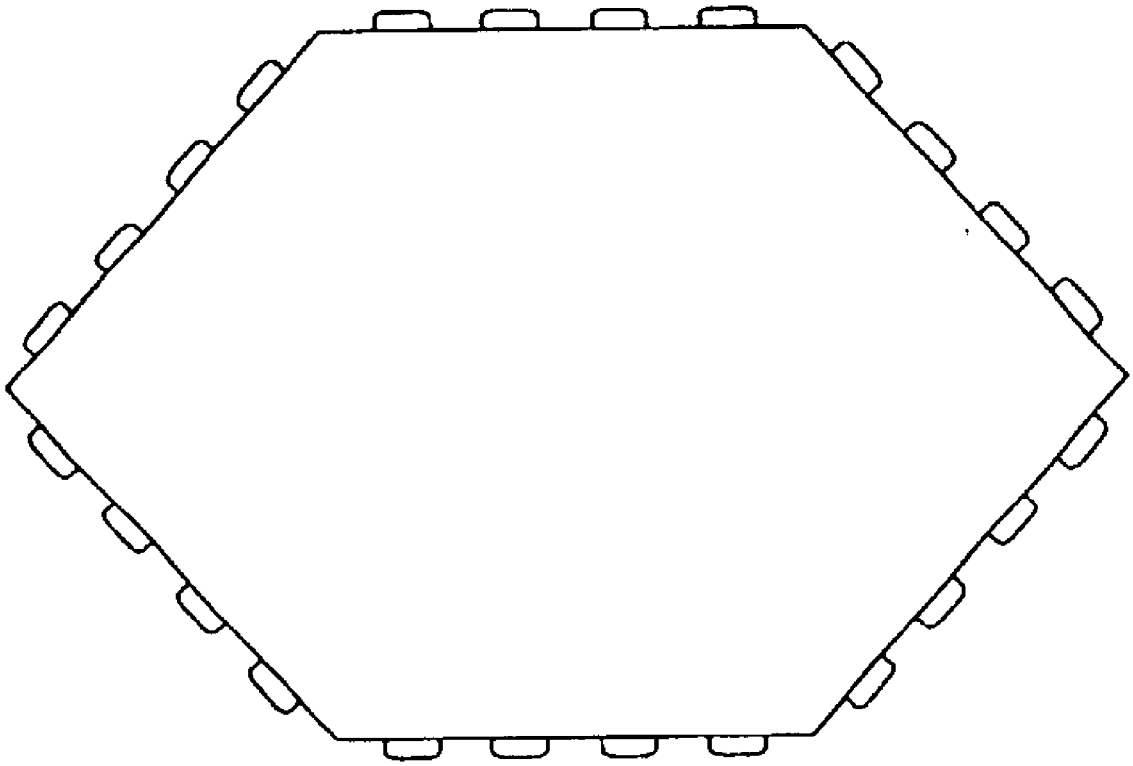
FIG. 3 is an end view of another example embodiment of the current invention.

In one example embodiment of the current invention the device would be configured to operate as a hand held device, for example a remote control. In this embodiment the controls on one face would be for controlling a first device. The controls on a second face would be for controlling a second device. For example, the controls on one face would be for a TV, and the controls on another face would be for controlling a VCR. In this example embodiment, there may be controls on more than 2 sides or faces. FIG. 2A shows a rectangular device that has controls on 3 sides of the device. A sensor in the device would detect which of the 3 sides is in a predetermined orientation, for example which side was facing upward. The upward facing controls would be enabled. The controls on the non-upward facing sides would be disabled. When the user rotated the device along axis 204, a new set of controls would become the upward facing controls and the newly oriented controls would be activated. In this example embodiment the device may be shapes other than rectangular. For example, there may be 6 faces with controls plus a front end and a back end (see FIG. 3). In one example embodiment of the current invention, an indicator would be located on each face, for example a light. The indicator would signal when the controls oh the face where active. For example, the light would be lit on the face when the controls on that face where active. The lights on the other faces would not be lit. This would help the user determine when the controls on each face or side become active.

In the hand held configuration, the sensor may be configured to be more sensitive to rotation in one axis than in another axis. For example, when the user rotated the device along axis 204, the determination of which face is in the upward orientation may occur after a rotation of 45 degrees. When the user rotated the device around axis 206, the device may not switch active faces until after a 90-degree rotation. This allows the user freedom to point the input device at different heights in a room without affecting which set of controls are active. In this application axis 204 will be defined as the y-axis and axis 206 will be defined as the x-axis. Axis 204 is the axis generally parallel to the sides containing the controls.

The foregoing description of the present invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A device, comprising:

at least two sides, where each of the at least two sides has a facing direction and where the facing direction for the at least two sides are different;

a first set of controls positioned on a first side of the at least two sides and a second set of controls positioned on a second side of the at least two sides;

a sensor configured to detect when the first side of the device is oriented in a predetermined facing direction, whereby the first set of controls are enabled.

2. The device of claim 1 where the second set of controls are disabled.

3. The device of claim 1 where the sensor has more tolerance for rotation along an x-axis than along a y-axis.

4. The device of claim 1 where the predetermined facing direction is a substantially upward facing direction.

5. The device of claim 1 where the first set of controls are used to control a first device and the second set of controls are used to control a second device.

6. The device of claim 1 where the first set of controls present a limited number of functions for controlling a device and the second set of controls presents a larger set of function for controlling the device.

7. The device of claim 1 where the device is a hand held device.

8. The device of claim 1 where the device is configured to operate resting on a surface.

9. The device of claim 1 further comprising:

a plurality of indicators, one indicator for each set of controls, the indicators configured to indicate which set of controls is currently the enabled set of controls.

10. The device of claim 1 where the sensor is a pressure switch.

11. The device of claim 1 where the sensor is a gravity activated sensor.

12. The device of claim 1 where the sensor is a magnetically activated sensor.

13. A device, comprising:

a first face having at least one control;

a second face having at least one control, the second face oriented in a different direction than the first face;

a sensor configured to determine which face is in an upward facing orientation, whereby the at least one control on the upward facing position is enabled.

14. The device of claim 13 where the at least one control on the non-upward facing orientation is disabled.

15. The device of claim 13 where the control on the first face controls a first device and the control on the second face controls a second device.

16. The device of claim 13 further comprising:

a first indicator positioned on the first face and a second indicator positioned on the second face, the indicators configured to activate when the at least one control on the corresponding face is enabled.

17. A device, comprising:

a first face having at least one control;

a second face having at least one control, the second face oriented in a different direction than the first face;

a sensor means for determining which face is in an upward facing orientation, whereby the at least one control on the upward facing position is enabled.

* * * * *